US005564322A

United States Patent [19]

Naldi

[11] Patent Number: 5,564,322

[45] Date of Patent: Oct. 15, 1996

[54] NOTCHING SYSTEM FOR PACKS OF EDGED PANELS

[75] Inventor: Valter Naldi, Bologna, Italy

[73] Assignee: Selco S.R.L., Via Emilia, Italy

[21] Appl. No.: 282,801

[22] Filed: Jul. 29, 1994

[30] Foreign Application Priority Data

Jul. 30, 1993 [IT] Italy ..... TO93A0573

[51] Int. Cl.[6] ..... B26D 7/01

[52] U.S. Cl. ..... 83/467.1; 83/488; 83/564; 83/917

[58] Field of Search ..... 83/563, 564, 917, 83/467.1, 468.6, 468.7, 477.1, 463, 464, 490, 881, 886, 887, 875, 488, 489; 493/370, 371, 60, 64, 66, 229, 232

[56] References Cited

U.S. PATENT DOCUMENTS

| | | | |
|---|---|---|---|
| 1,014,595 | 1/1912 | Hand | 83/564 |
| 2,180,743 | 11/1939 | Martin | 83/564 |
| 2,815,811 | 12/1957 | Feiertag | 83/917 |
| 3,136,071 | 6/1964 | Hill | 83/468.6 |
| 3,296,914 | 1/1967 | Shallenberg | 83/563 |
| 3,859,882 | 1/1975 | Demuth | 83/490 |
| 4,098,154 | 7/1978 | Whitten | 83/875 |
| 4,335,637 | 6/1982 | Kaltenbach | 83/490 |
| 4,869,142 | 9/1989 | Sato et al. | 83/467.1 |
| 5,018,562 | 5/1991 | Adams | 83/468.7 |
| 5,203,245 | 4/1993 | Terpstra | 83/490 |
| 5,301,726 | 4/1994 | Wojcik | 83/467.1 |

*Primary Examiner*—Eugenia Jones
*Assistant Examiner*—Charles Goodman
*Attorney, Agent, or Firm*—Ladas & Parry

[57] ABSTRACT

A system for notching a pack of edged panels, and including: a work surface for supporting the pack; a squaring bar for aligning the panels in the pack; a notching blade for notching the edges of the panels in the pack; a body for supporting the notching blade; and means for controlling the body. The system is mainly characterized in that, during notching, the body is moved along a horizontal path; and the notching blade presents a diameter greater than the thickness of the pack.

8 Claims, 2 Drawing Sheets

NOTCHING SYSTEM FOR PACKS OF EDGED PANELS

BACKGROUND OF THE INVENTION

The present invention relates to a notching system for packs of edged panels.

As is known, when cutting edged panels, to prevent the edging of the panels from being damaged by the cutting blade, a system with a notching blade is provided for notching the edges. Present systems comprise a small-diameter notching blade, and a member for effecting a series of movements (four for each notching cycle) of the notching blade. The main drawbacks of such systems lie in the number of movements required of the notching blade; the complex design of the blade control member; and the duration of each notching cycle. Moreover, the considerable distance between the notching blade and the means controlling the blade control member results in inaccurate alignment of the blade and the notching line.

SUMMARY OF THE INVENTION

It is an object of the present invention to provide a notching system designed to overcome the aforementioned drawbacks.

According to the present invention, there is provided a notching system for packs of edged panels, the system comprising:

a work surface for supporting the pack;

a squaring bar for aligning the panels in the pack;

a notching blade for notching the edges of the panels in the pack;

a body for supporting the notching blade; and means for controlling said body; characterized in that, during notching, said body is moved along a horizontal path; and the notching blade presents a diameter greater than the thickness of said pack.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
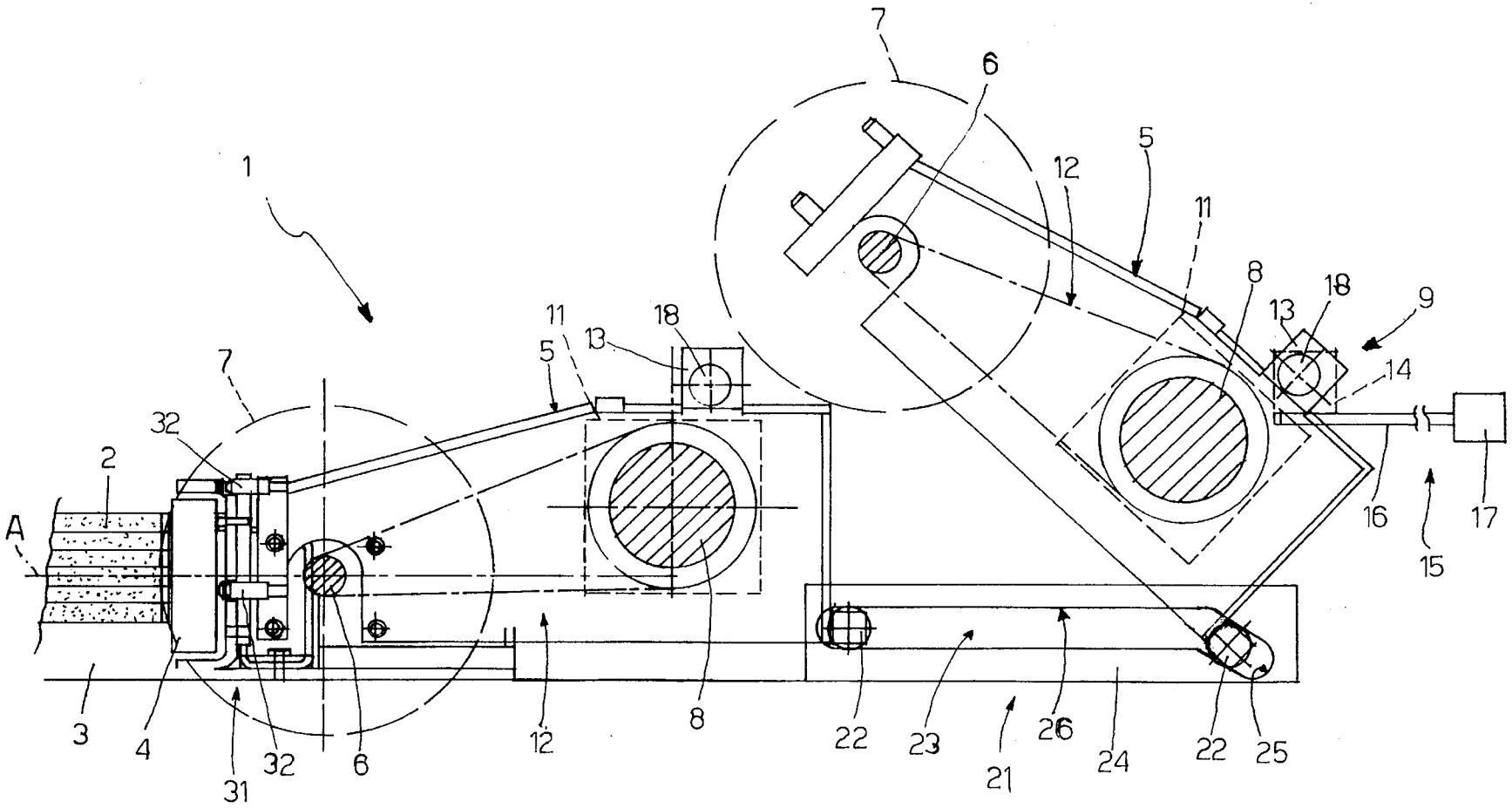
FIG. 1 shows a schematic side view of a notching system in accordance with the teachings of the present invention.
Figure 2:
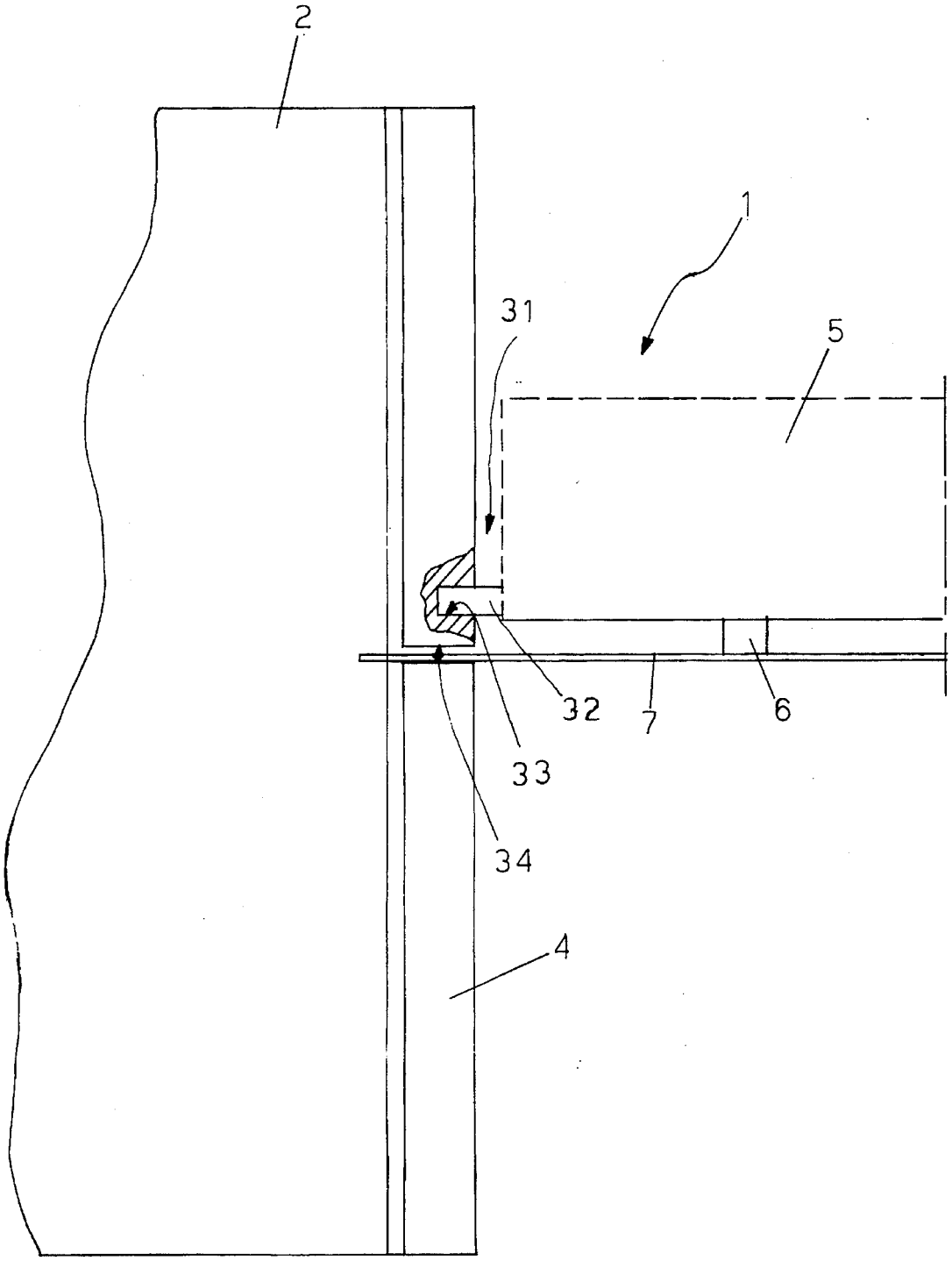
FIG. 2 shows a partial plan view of the FIG. 1 system.

Number 1 in FIGS. 1 and 2 indicates a system for notching a pack 2 of edged panels supported on a work surface 3 and aligned, by push means not shown, against a squaring bar 4. System 1 comprises a box-shaped body 5 supporting, at the front, a rotary shaft 6 fitted with a notching blade 7, and, at the rear, the output shaft 8 of a motor 11, with the axis of shaft 8 parallel to that of shaft 6. Body 5 houses a belt device 12 by which shaft 8 rotates shaft 6 and hence blade 7. System 1 also comprises a actuator means 15 for moving body 5, and presenting a horizontal bar 16 moved axially and coplanar with itself by control means 17 preferably consisting of a hydraulic actuator. Between bar 16 and body 5, there is defined an articulated joint 9 presenting two hollow, side by side blocks 13 and 14, and a shaft 18 housed inside blocks 13 and 14. Block 13 is integral with the upper face of body 5; block 14 is integral with the free axial end of bar 16; and body 5 rotates about the axis of shaft 18.

In actual use, body 5 presents an idle position wherein bar 16 is withdrawn and the axis of shaft 6 lies in a plane higher than that defined by bar 16; and an operating position wherein bar 16 is extracted towards pack 2 and the axis of shaft 6 lies substantially in the center plane A of pack 2. Body 5 is moved from the idle to the operating position by actuator means 15 and by a device 21 for guiding body 5 and which comprises a bearing 22 carried on a rear lower face portion of body 5 and running along a race 23 formed in a body 24. Race 23 presents an inclined portion 25 disposed at a rear portion of the body 24 and a horizontal portion 26 that extends from the inclined portion to a front portion of the body 24 towards the pack, such that the inclined portion 25 defines an obtuse angle with respect to the horizontal portion 26. When body 5 is in the idle position, bearing 22 engages portion 25; and, when body 5 is in the operating position, bearing 22 engages the portion of portion 26 closest to pack 2.

System 1 also comprises a device 31 for centering body 5 on bar 4, and which presents two pins 32 on the front face of body 5, and two centering holes 33 formed in bar 4 and engaged by pins 32 when body 5 is in the operating position. Bar 4 presents a through opening 34 through which blade 7 contacts the edges of the panels in pack 2, and to the side of which centering holes 33 are formed at different levels. Blade 7 presents a larger diameter than pack 2 and, by virtue of the axis of shaft 6 lying substantially in the center plane A of pack 2, contacts the top and bottom edges of pack 2 substantially simultaneously.

The advantages of the present invention will be clear from the foregoing description.

In particular, it provides for a notching blade 7 of such a size as to notch the entire pack 2 with no upward or downward movement of the blade required. By virtue of the axis of shaft 6 lying substantially in the center plane A of pack 2, blade 7 provides for notching the pack symmetrically in relation to center plane A. System 1 also provides for high-speed operation by reducing the number of movements required at each notching cycle; and, in addition to presenting straightforward, easy-to-produce control members, also features a centering device for accurately aligning blade 7 and the notching line.

Clearly, changes may be made to system 1 as described and illustrated herein without, however, departing from the scope of the present invention.

I claim:

1. A notching system for packs (2) of edged panels, the system comprising;

a work surface (3) for supporting a pack (2) of panels, said pack of panels presenting a predetermined thickness and defining a horizontal center plane;

a squaring bar (4) for aligning the panels in the pack (2);

a notching blade (7) for notching edges of the panels in the pack (2), said notching blade (7) presenting a diameter greater than the thickness of said pack (2) and mounted for rotation about an axis which lies substantially in said center plane (A) of said pack (2) during a first operating position;

a body (5) for supporting the notching blade (7);

a device (21) for guiding the body (5) between said first operating position and a second idle position;

actuator means (15) for moving said body (5) along said guide device (21) between said first operating position and said second idle position, said body (5) being moved horizontally during operation along said guide device; and a device (31) for centering said body (5) on said squaring bar (4) and presenting at least one pin (32) on a front face of said body (5), and a centering hole (33) formed in said squaring bar (4) and engaged by said pin (32) when said body (5) is in the first operating position.

2. A system as claimed in claim 1, wherein said actuator means (15) comprises an axially movable control bar (16); a joint (9) connecting said control bar (16) and said body (5); and said guide device (21) for guiding said body (5) presenting said second idle position wherein the rotation axis of the notching blade (7) lies in a higher plane than that defined by said control bar (16), and said first operating position wherein said control bar (16) moves towards said pack (2) and the rotation axis of the notching blade (7) lies substantially in said center plane (A) of the pack (2).

3. A system as claimed in claim 2, wherein said joint (9) comprises two hollow, side by side blocks (13, 14), and a shaft housed inside said blocks (13,14) and having an axis around which said body (5) rotates; a first said block (13) being connected with said body (5); and, a second said block (14) being connected with said control bar (16).

4. A system as claimed in claim 2, wherein said guide device (21) comprises a bearing (22) carried by said body (5) and a race (23) along which said bearing (22) runs, said race (23) presenting a small inclined portion (25) followed by a long horizontal portion (26) extending towards the pack (2); said small portion (25) being engaged by said bearing (22) when said body (5) is in said second idle position, and said long portion (26) engaging said bearing (22) when said body (5) is in the first operating position.

5. A notching system for a pack of edged panels having a predetermined thickness, said system comprising:

a work surface for supporting a pack of edged panels, said pack of panels defining a horizontal center plane between an upper surface of said pack and said work surface;

a squaring bar for aligning said panels in said pack;

a notching blade for notching edges of said panels in said pack, said notching blade having a diameter greater than said thickness of said pack and mounted for rotation about an axis lying substantially in said horizontal center plane of said pack during a first notching position;

a body for supporting said notching blade;

a means for controlling said body and for enabling said body to move along a horizontal path during a notching operation; and a device for centering said body on said squaring bar and presenting at least one pin on a front face of said body, and a centering hole formed in said squaring bar and engaged by said pin when said body is in said first notching position.

6. A system as claimed in claim 5, wherein said controlling means comprises:

a control bar that is axially movable with respect to said body;

a joint connecting said control bar to said body and enabling axial movement of said body; and, a device for guiding said body between a second idle position wherein said rotation axis of said notching blade lies in a higher plane than that defined by said control bar, and, said first notching position wherein said control bar moves towards said pack with said rotational axis of said notching blade lying substantially in said center plane.

7. A system as claimed in claim 6, wherein said joint comprises two hollow, adjacently positioned blocks, and a shaft housed inside said blocks and defining an axis around which said body rotates, a first of said blocks being connected with said body, and a second of said blocks being connected with said control bar.

8. A system as claimed in claim 6, wherein said guiding device comprises a bearing carried by said body, and a race along which said bearing runs, said race having a small inclined portion extending away from said pack for engaging said bearing when said body is in said idle position, and followed by a long horizontal portion extending towards said pack for engaging said bearing when said body is in said first notching position.

* * * * *